US007127783B1

(12) United States Patent
Poole, Jr. et al.

(10) Patent No.: US 7,127,783 B1
(45) Date of Patent: Oct. 31, 2006

(54) UNDERWATER BURIAL GARDEN METHOD

(76) Inventors: A. Davis Poole, Jr., 677 Rhine Rd., White, GA (US) 30184; Laurie K. Poole, 677 Rhine Rd., White, GA (US) 30184

( * ) Notice: Subject to any disclaimer, the term of this patent is extended or adjusted under 35 U.S.C. 154(b) by 0 days.

(21) Appl. No.: 11/414,006

(22) Filed: Apr. 28, 2006

Related U.S. Application Data

(60) Provisional application No. 60/677,227, filed on May 2, 2005.

(51) Int. Cl.
*A61G 17/00* (2006.01)

(52) U.S. Cl. ..... 27/1; 405/210; 52/133

(58) Field of Classification Search ..... 27/1; 405/210; 52/134, 136, 133
See application file for complete search history.

(56) References Cited

U.S. PATENT DOCUMENTS 3,732,602 A * 5/1973 Vigh ..... 27/1
4,041,582 A * 8/1977 MacDonald ..... 27/2
5,127,112 A * 7/1992 Brock ..... 27/1
5,393,253 A * 2/1995 Humble et al. ..... 441/32
5,774,958 A * 7/1998 Casimir ..... 27/1
6,041,483 A * 3/2000 Burch ..... 27/1
6,055,793 A * 5/2000 Irwin et al. ..... 53/436
6,189,188 B1 * 2/2001 O'Hare ..... 27/1
6,261,028 B1 * 7/2001 Volpe et al. ..... 405/210
6,662,416 B1 * 12/2003 Huggins ..... 27/1
7,024,735 B1 * 4/2006 Huggins ..... 27/1

OTHER PUBLICATIONS

Patricia Huang; Underwater Undertaking; May 22, 2006; Forbes.com.

* cited by examiner

*Primary Examiner*—William L. Miller
(74) *Attorney, Agent, or Firm*—Thomas, Kayden, Horstemeyer & Risley

(57) ABSTRACT

A method for establishing underwater burial garden comprises drilling one or more holes into an underwater floor surface to a predetermined depth. Each hole in the underwater burial garden may be located at a predetermined location, or plot, respective to any other hole, which may be in an adjacent or nearby plot. A sealed container containing ashes of a cremated individual may be positioned into a hole. The sealed container may be constructed of a material to withstand the underwater environment. A cap may be placed over the hole, thereby containing the sealed container within the hole. The cap may have a plate positioned thereon with text pertaining to the cremated individual, which may be viewable by swimmers and/or boaters.

23 Claims, 12 Drawing Sheets

105

UNDERWATER BURIAL GARDEN METHOD

CROSS REFERENCE TO A RELATED APPLICATION

This application claims priority to now abandoned U.S. Provisional Application Ser. No. 60/677,227, which is entitled, "Underwater Burial Garden System and Method," as filed on May 2, 2005, which is entirely incorporated by reference. This application is also related to copending U.S. patent application entitled, "Underwater Burial Garden System," filed on Apr. 28, 2006, having Ser. No. 11/414,748, under Express Mail Label EL 993860809 US, which is also incorporated herein by reference.

TECHNICAL FIELD

The present disclosure relates to the final resting place for living beings, and more particularly, to a system and method for establishing and maintaining an underwater burial garden.

BACKGROUND

For centuries, since man has been sailing the seas of the world, people have been buried at sea. From depositing a deceased person's body in the water to sprinkling ashes into the ocean, individuals have for centuries desired their final resting place to be in the oceans of the world.

However, when a deceased person's body or ashes are deposited in the sea, there is generally no fixed location that loved ones may visit, as with a conventional cemetery. Because wave currents may disseminate a person's ashes or body into the ocean, loved ones may not have the ability to revisit a point of deposit or other point that may be reserved in memory of the deceased individual.

In attempt to accommodate some of these concerns, more recent systems have emerged wherein an individual's ashes may be added to sinkable objects that are dropped into the water at sea. These objects may be constructed such that the ashes are mixed into the materials of the sinkable object such as cement. However, these objects may be dropped at depths and/or locations wherein making a return visit for viewing by boat or even by scuba diving may be difficult, improbable, or even impossible. Plus, the size of such sinkable objects may oftentimes be sufficiently large to overcome any affects of water currents and/or other natural affects, thereby increasing both the maneuvering difficulty during manufacturing and placement at sea size and also the associated costs.

Thus, there is a heretofore unaddressed need to overcome the inefficiencies and shortcomings as described above.

DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views. While several embodiments are described in connection with these drawings, there is no intent to limit the disclosure to the embodiment or embodiments disclosed herein. On the contrary, the intent is to cover all alternatives, modifications, and equivalents.

DETAILED DESCRIPTION

Figure 1:
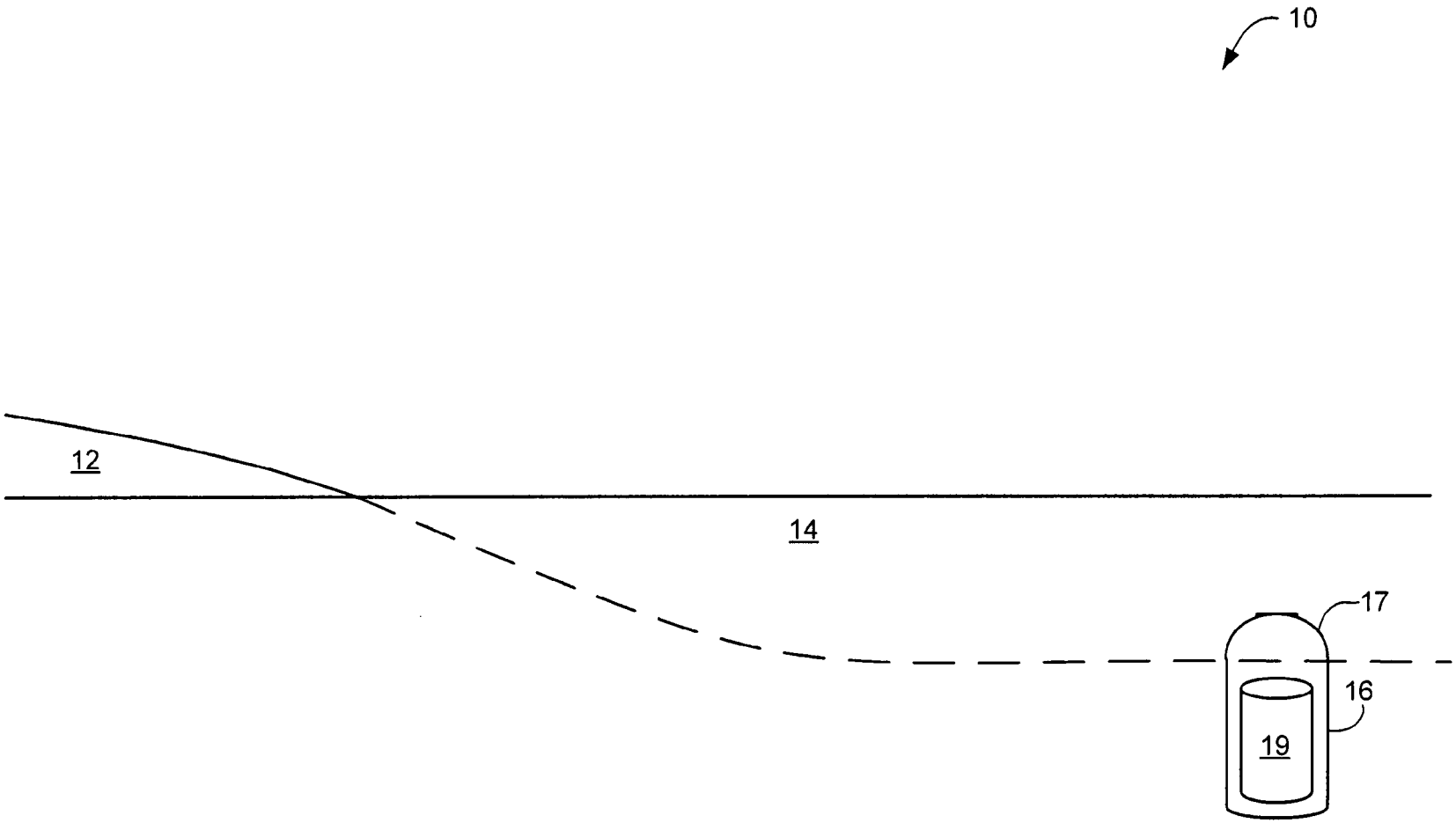
FIG. 1 is a diagram of an exemplary underwater burial site of the present disclosure wherein a vessel shown therein may contain a person's cremated ashes.

This disclosure pertains to an underwater burial garden wherein remains of an individual may be deposited in the ground beneath water at a depth such that loved ones left behind may have an opportunity to return and pay respects after burial. In this nonlimiting example, FIG. 1 depicts an underwater burial site 10 wherein vessel 19 may contain a person's ashes at position 13. Vessel 19 may be deposited in container 16 and sealed or covered by a cap 17 under water 14. Thus, living individuals may come to land 12 and either swim or boat to the location of a person's remains in vessel 19.

In this nonlimiting example, container 16 may be deposited in the seabed floor under water 14 such that the currents of the water 14 do not alter the location of the container 19. Cover 17, in this nonlimiting example, may be an environmentally-friendly type of cover, such as to promote coral growth or a fish habitat.

Figure 2:
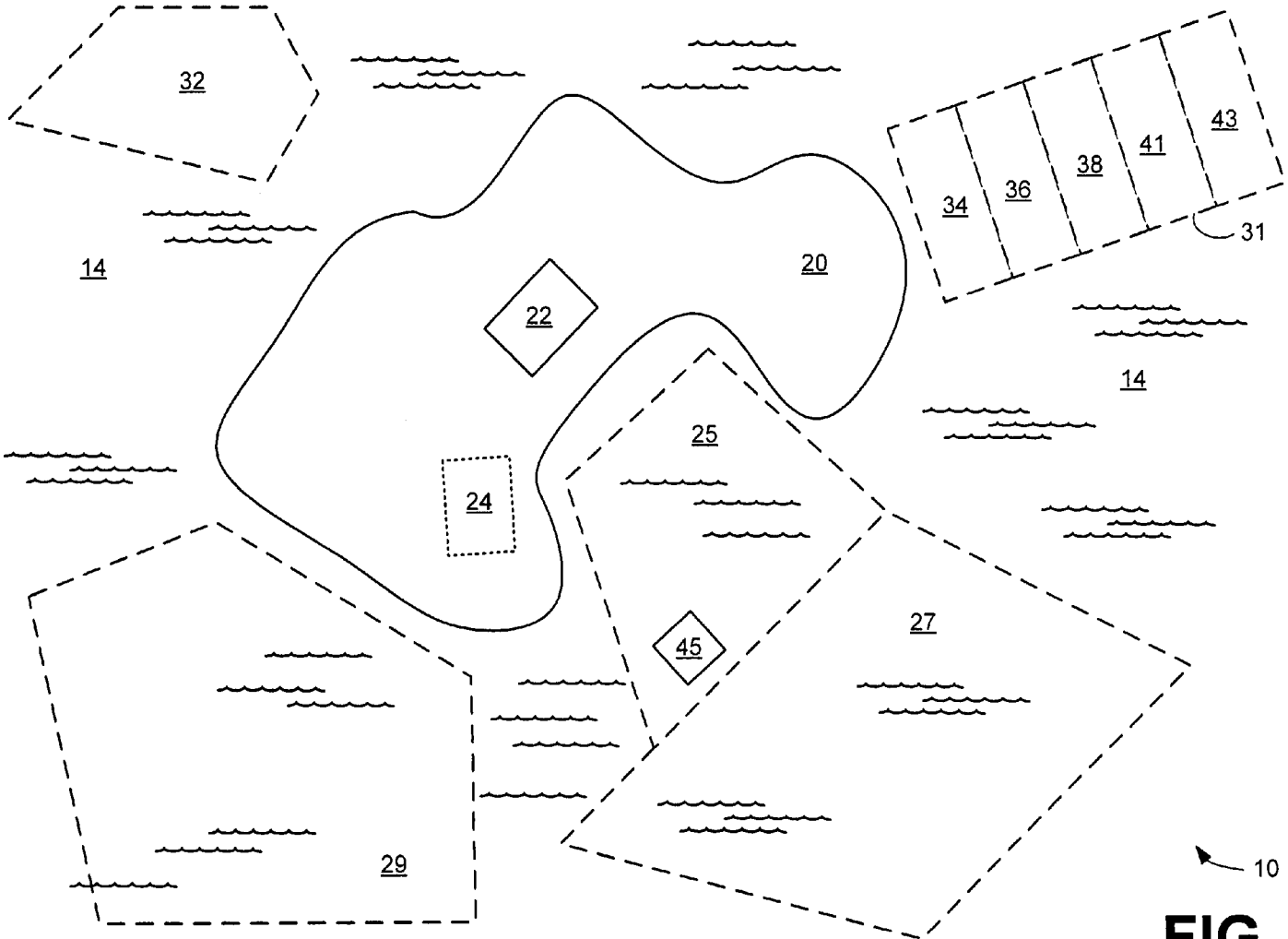
FIG. 2 is a diagram of an island having a number of the underwater burial gardens positioned in the water nearby the island, each garden having a number of the underwater burial sites of FIG. 1.

The underwater burial site 10 of FIG. 1 may be replicated on a larger scale so as to create an underwater cemetery or burial garden, as shown in FIG. 2. In FIG. 2, island 20 is surrounded by water 14; however one of ordinary skill in the art would know that the underwater burial garden 10 may be implemented at any underwater area which may or may not necessarily include a shoreline, such as the one shown in FIG. 2 as created by island 20.

A memorial center 22 may be located on island 20 such that loved ones of the deceased buried in the underwater burial garden 10 of FIG. 2 may visit to pay respects to their loved ones. In at least one nonlimiting example, the memorial center 22 may be configured with multimedia interactive memorials dedicated to the various individuals buried in the underwater burial garden 10 shown in FIG. 2. As a nonlimiting example, the memorial center 22 may contain electronic media displays depicting the deceased during various times of their life, and/or other memorabilia related to the deceased, such that loved ones may enhance their visit to the underwater burial garden 10. Additionally, the displays may also show images of the various burial sites in the underwater burial garden 10 of FIG. 2.

Island 20 may also include one or more areas 24, which may, in this nonlimiting example, be set aside for a memorial paver area also dedicated to the deceased individuals buried in the underwater burial garden 10. As a nonlimiting example, area 24 may contain stone, concrete, or other types of memorial items dedicated to the various individuals buried in the underwater burial garden 10, such as may be found in a cemetery. Consequently, one of ordinary skill in the art would know that one or more other more traditional memorial techniques may be implemented on island 20 in addition to the underwater burial garden 10, as shown in FIG. 2.

As a nonlimiting example, the underwater burial garden 10 of FIG. 2 may comprise multiple sections for underwater burial of deceased individuals. In this nonlimiting example, underwater burial sections 25, 27, 29, and 31 represent separate distinct underwater burial gardens that may be established proximate to island 20. One of ordinary skill in the art would know that the topology of the underwater seabed may guide the placement of the various underwater burial gardens 25, 27, 29, and 31 into the various shapes as shown. Stated another way, the type of sea floor, as well as the topology changes around the island, may make one area more desirable and another area less desirable. In addition, marketing concerns may make area 25, in this nonlimiting example, more desirable than area 27, which is further displaced from island 20. Thus, in this nonlimiting example, individuals who may enjoy scuba diving may prefer area 25 over area 27 due to the depth of water in area 25 as opposed to area 27, and/or vice versa.

As another nonlimiting example, individuals who desire to view the underwater memorial garden from a glass bottom boat may more easily see the sea floor in area 25 which may be in shallower water, than in area 27, which may be in deeper water. Consequently, marketing factors may dictate various pricing schemes for flat locations within the underwater burial garden 10 within the various areas 25, 27, 29, and 31, of underwater burial garden 10 in FIG. 2.

Furthermore, marketing considerations may also dictate the set aside of specific areas for specific types of deceased individuals buried in the underwater burial garden of FIG. 2. In this nonlimiting example, area 31 may be subdivided into one or more subparts. Thus, sections 34, 36, 38, 41, and 43 may be set aside for, in this nonlimiting example, branches of the military, including the Army, Navy, Air Force, Marines, and/or Coast Guard. One of ordinary skill in the art would know that dedicated sections 34, 36, 38, 41, and 43 may be established for any specific group or interest in addition to the military example provided above.

Figure 3:
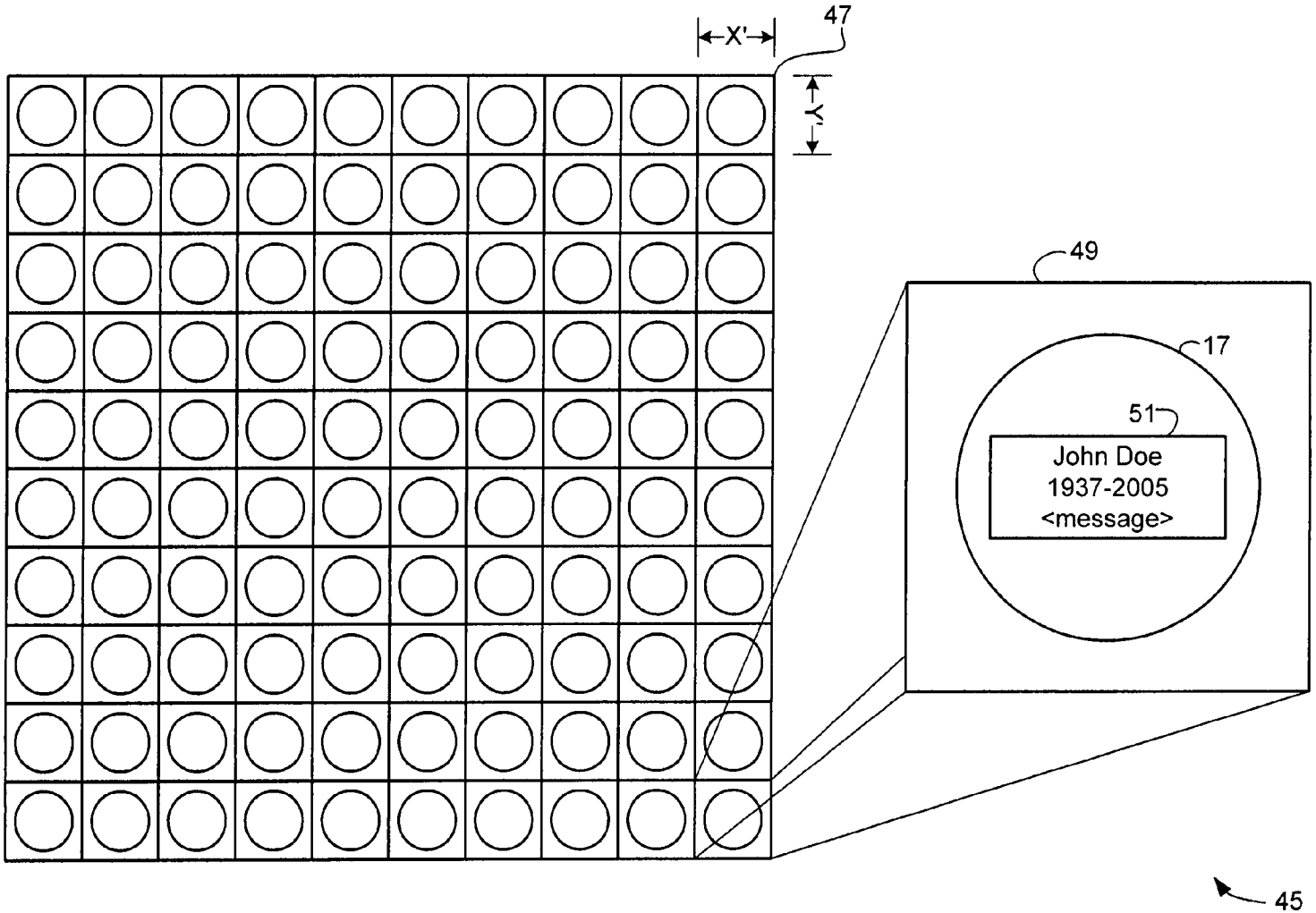
FIG. 3 is a diagram of a portion of the underwater burial garden of FIG. 2 that has a number of the underwater burial sites of FIG. 1.

Also shown in FIG. 2. is quadrant 45, which is located in area 25 of the underwater burial garden 10. FIG. 3 is a diagram of quadrant 45 depicting, in this nonlimiting example, 100 underwater burial locations in quadrant 45, which is also in area 25 of the underwater burial garden 10.

As shown in FIG. 3, quadrant 45 contains 100 burial plots, which may be situated proximate to each other such that the plots are sized as one of ordinary skill in the art would know. Stated another way, plot 47 may have X and Y dimensions of any shape and size, as one of ordinary skill in the art would know, sufficient to create the underwater burial garden 10 of FIG. 2. In at least one nonlimiting example, the X and Y dimensions of burial plot 47 which may be uniformly created for quadrant 45 may be 4'×4,' 6'×6,'8'×8,' or any other configuration desired.

Returning to FIG. 2, market forces may dictate the establishment of various areas 25, 27, 29, and 31 having different plot sizes which may increase or decrease the value of the various plots in the various areas. Stated another way, the larger the plot in a particular area of the underwater burial garden, the more valuable the plot may be to obtain by the loved ones of a deceased individual.

Quadrant 45 also depicts plot 49, which is shown in an enlarged view in FIG. 3. The cap section 17 is shown centered in plot 49; however, one of ordinary skill in the art would know that the cap 17 may be placed at any point within plot 49 and still be within the scope of this disclosure. Nevertheless, in this nonlimiting example, cap 17 contains a message plate 51, which may be comprised of any suitable material for the underwater environment in which it will be placed. In at least one nonlimiting example, plate 51 may be constructed of bronze so as to endure the salt water environment in which plate 51 may be located. Plate 51 may contain identifying information about the deceased individual whose ashes or remains are stored at plot 49, such as the individual's dates of birth and death and any other message that may be commonly located on a tombstone in a cemetery, as one of ordinary skill in the art would know. Plot 49 may be replicated for the remaining plots shown in quadrant 45 as well as all other plots in the underwater burial garden 10 of FIG. 2.

Figure 4A:
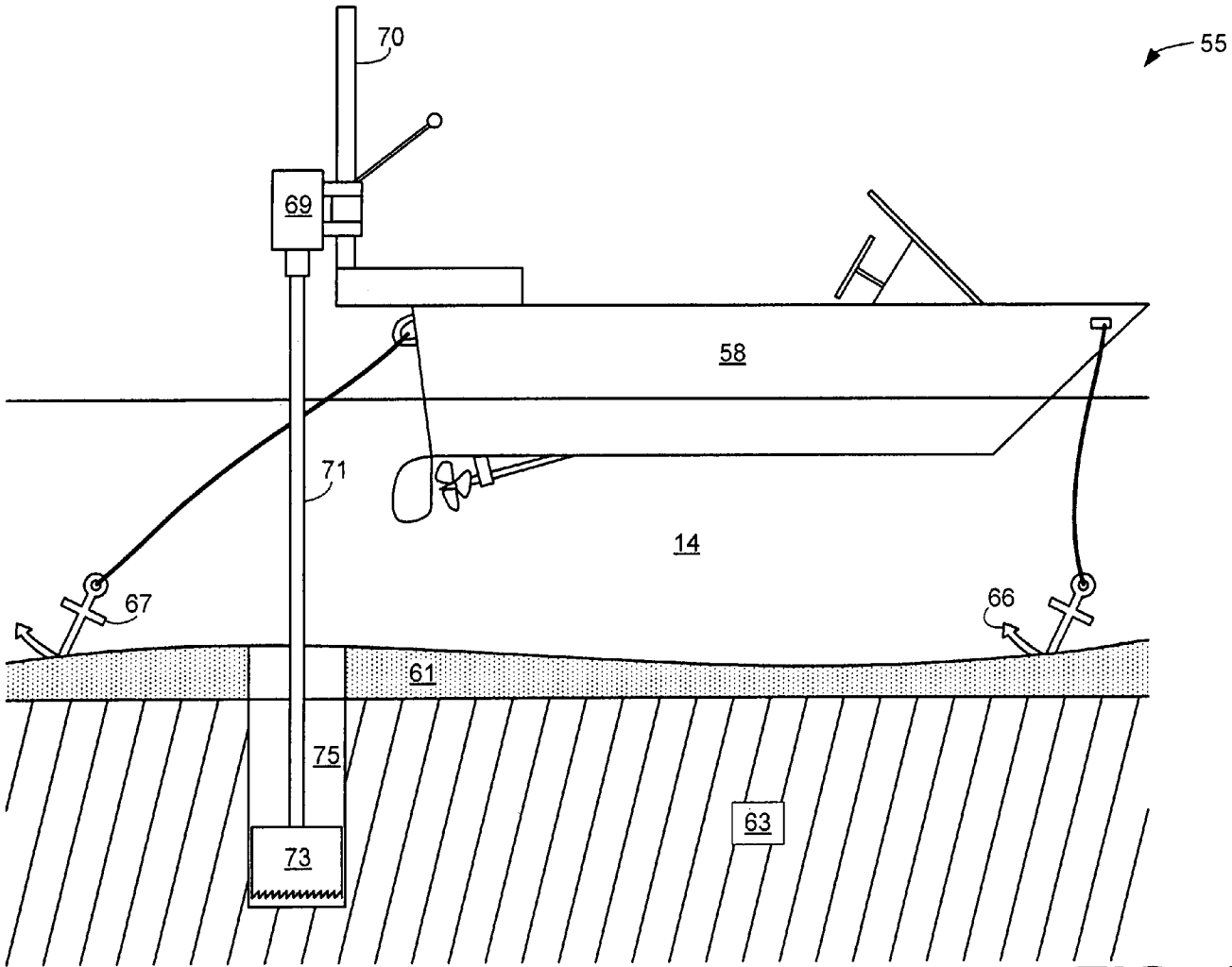
FIG. 4A is a diagram of at least one process for creating the underwater burial garden of FIG. 2.

FIG. 4A is a diagram of at least one procedure for creating the underwater burial garden, as shown in FIG. 2. In this nonlimiting example 55, a boat 58 may be positioned over a desired point in the sea floor, which may be comprised of sand portion 61 and coral portion 63. Continuing with this nonlimiting example 55, boat 58 may be held in a stationary position by anchors 66 and 67 so that core drill 69 may be used to create hole 75 in the sand 61 and coral 63.

As shown in FIG. 4A, core drill 69 may move essentially vertically along shaft 70 so that rotating shaft 71 turns cutting bit 73 to create hole 75. Depending upon the depth of water 14, shaft 71 may, in this nonlimiting example, be various lengths, as one of ordinary skill in the art would know. Nevertheless, as boat 58 is held in a stationary position, core drill 69 may be used to core drill a hole 75 to a desired depth in sand 61 and coral 63.

One of ordinary skill in the art would also know that other methods for creating hole 75 may be used in addition to nonlimiting example 55 shown in FIG. 4A. As an additional nonlimiting example, a diver may swim in water 14 to a desired position and use another type of drilling apparatus, such as a tripod drill, to create hole 75, as one of ordinary skill in the art would know.

Figure 4B:
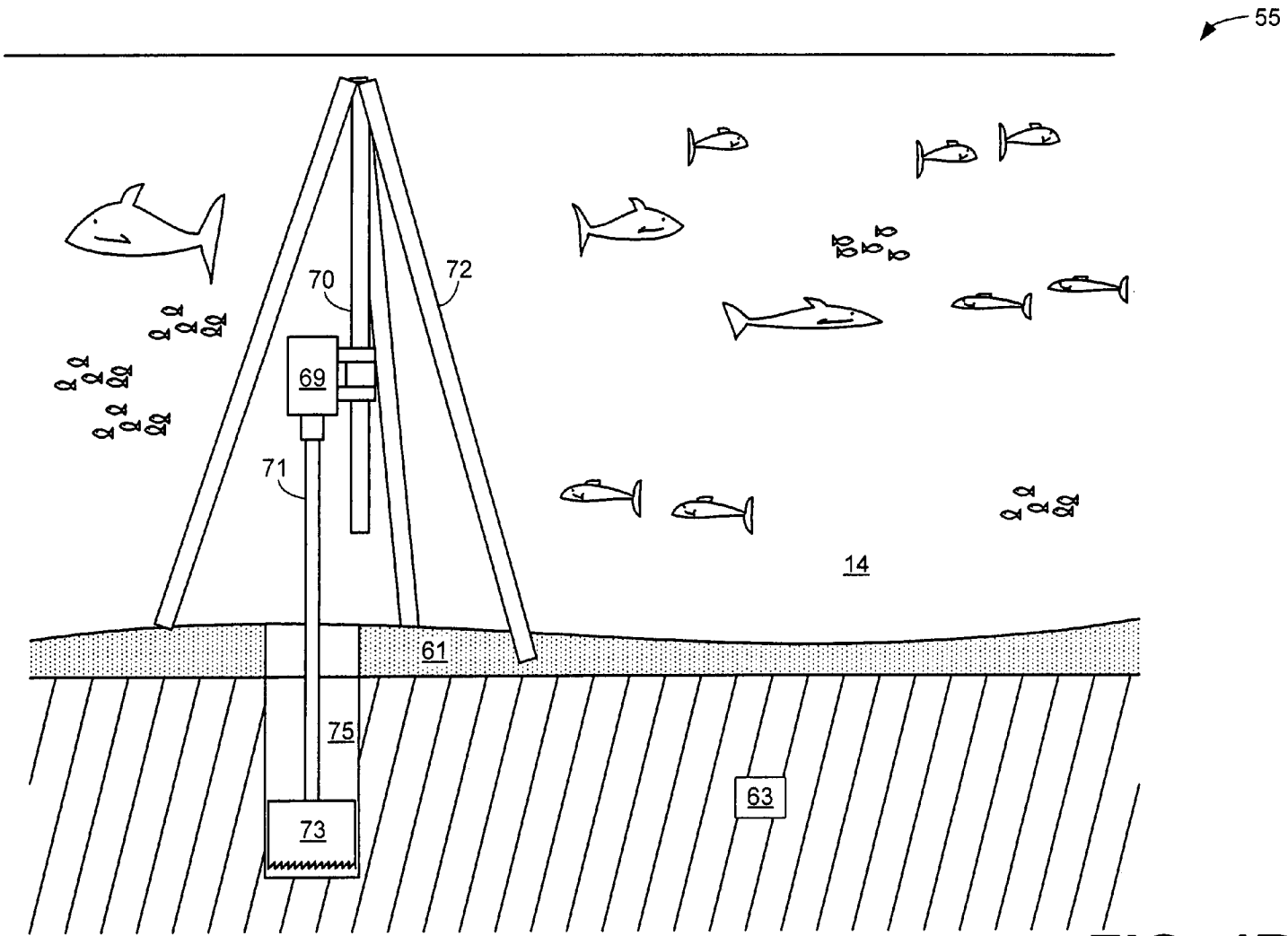
FIG. 4B is a diagram of an alternative embodiment for drilling a hole for creating the underwater burial garden of FIG. 2.

FIG. 4B depicts an alternative embodiment for drilling hole 75. In this nonlimiting example, core drill tripod 72 may be used by a diver to create hole 75, as one of ordinary skill in the art would know.

Figure 5:
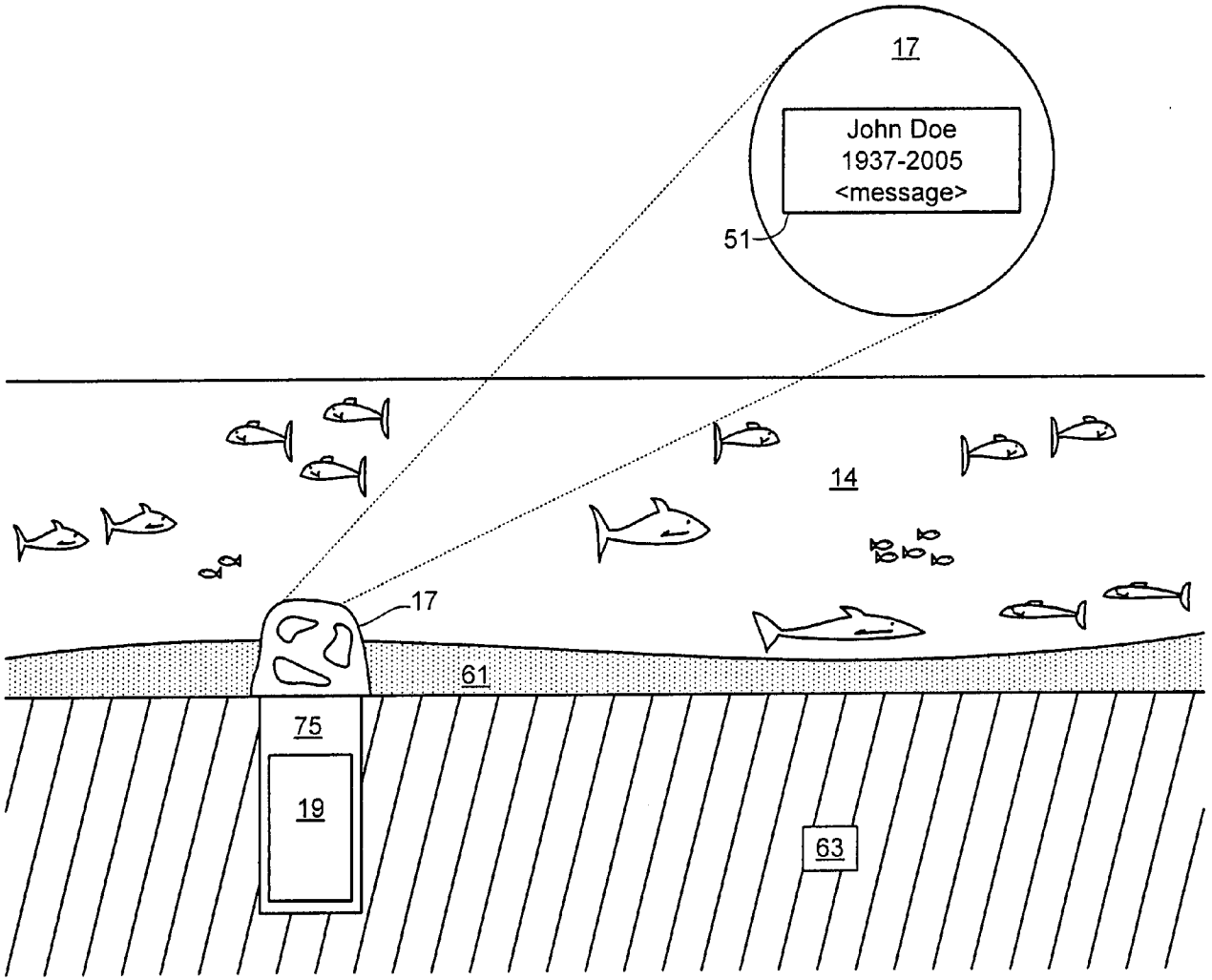
FIG. 5 is a diagram of an installed underwater burial site of FIG. 1 further depicting an identification plate.

FIG. 5 is a diagram of an installed underwater burial location housing vessel 19 containing ashes of a deceased individual. In this nonlimiting example, after a hole has been established according to the nonlimiting example 55 of FIG. 4A, a vessel 19 containing the remains of the deceased individual may be deposited in the hole 75. Similarly, a cap 17 may be placed over the hole 75 to keep vessel 19 within the hole 75.

Vessel 19 may be constructed of any material suitable for such an application, as one of ordinary skill in the art would know. In at least one nonlimiting example, vessel 19 may be configured of bronze so as to withstand the underwater environment to which it may be placed in, as well as to protect the ashes of the individual buried in this location.

Cap 17 may also be constructed of various materials, as one of ordinary skill in the art would know. As nonlimiting examples, cap 17 may be constructed as a reef cap, bronze cap, or a coral style. Each of these caps 17 may be configured so as to promote the underwater environment and not harm fish and other living creatures in water 14. As a nonlimiting example, the coral style cap 17 may be installed so as to promote coral growth on the seabed floor. As an additional nonlimiting example, themed caps may be constructed according to the desires of the loved ones of the deceased individual. In a nonlimiting example, a nautical themed cap 17 may be used for an individual who may have been a sailor during his or her lifetime. One of ordinary skill in the art would know, therefore, that other themed caps 17 may be implemented according to the desires of the loved ones of the deceased individual.

However, the top section of cap 17 may include plate 51 with the deceased individual's name, dates of birth and death, as well as any other final words that loved ones of the deceased individual may choose for display. Plate 51 may be, in this nonlimiting example, constructed of bronze, gold, or any other material so as to withstand the environmental rigors on seabed floor 61 and 63.

Figure 6:
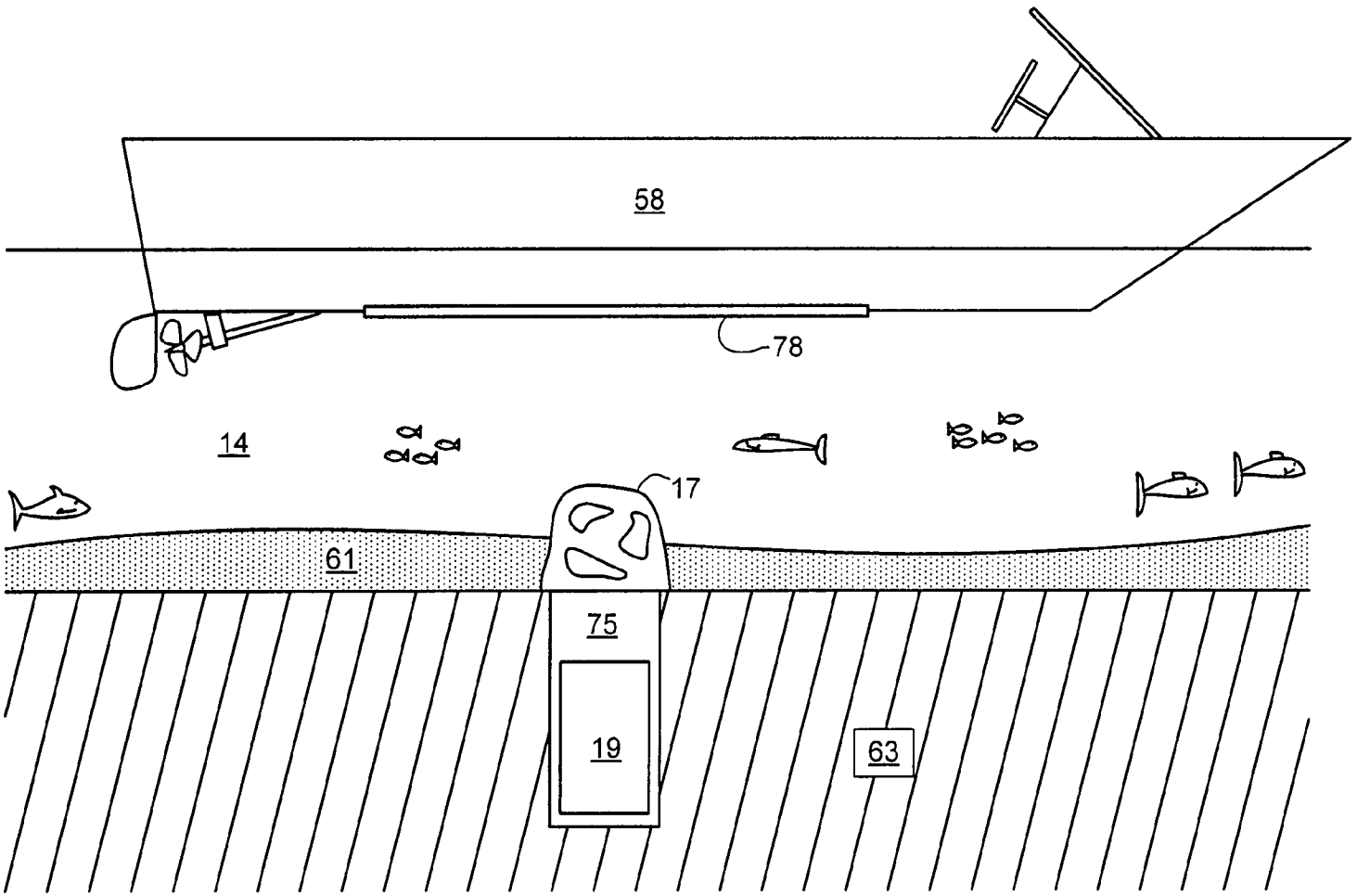
FIG. 6 is a diagram of the underwater burial site of FIG. 1 shown such that a boat may be appropriately positioned for underwater viewing of the underwater burial site.

FIG. 6 is a diagram of the underwater burial location shown in the previous figures with boat 58 configured for underwater viewing. In this nonlimiting example, boat 58 may contain a glass bottom section 78 such that passengers in boat 58 may see through the bottom of boat 58 into the water 14 and to the sea floor 61. Consequently, passenger boat 58 may be able to position boat 58 directly above cap 17 that may correspond to the passengers' deceased loved one whose ashes may be contained in vessel 19. As stated above, the ash remains of the deceased individual may be placed in vessel 19 in hole 75 and covered by cap 17 such that the passengers in boat 58 may position the boat 58 periodically over this location to pay respects.

Depending upon the depth of water 14, the passenger boat 58 may be able to not only see but also read any information contained on name plate 51, as shown in FIG. 5. Also in FIG. 2, the various areas of the underwater burial garden 10 may be in various depths of water, therefore making viewing through glass bottom boat 58 more or less difficult, which also may increase or decrease the marketability of certain plots in the underwater burial garden 10.

Figure 7:
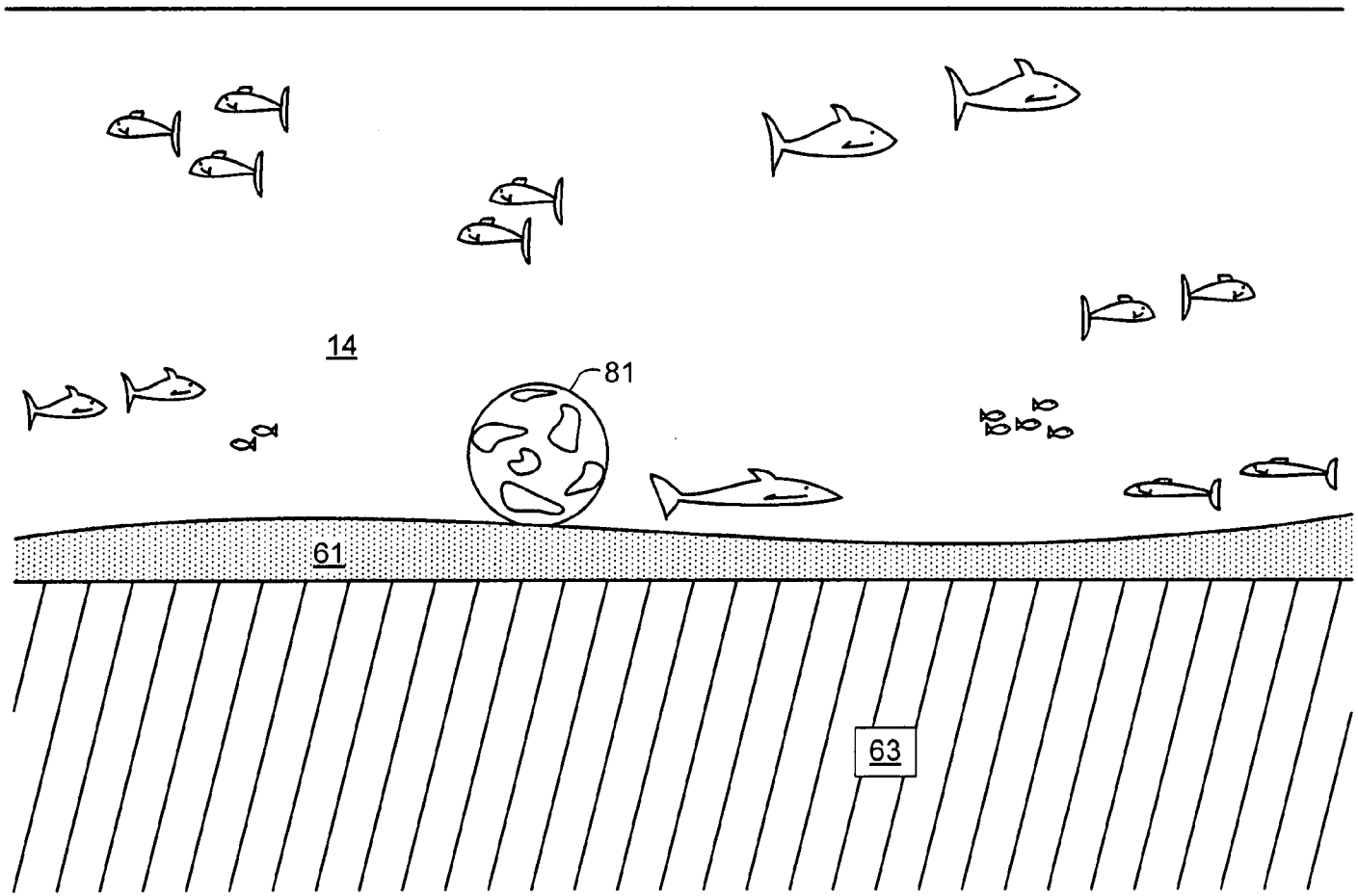
FIG. 7 is a diagram of an alternative embodiment of the underwater burial site of FIG. 1.

FIG. 7 is a diagram of an alternative embodiment of the underwater burial site of FIG. 1. In this nonlimiting example, instead of core drilling a hole in seabed floor 61 and 63, a reef ball 81 may be constructed to house the remains of the deceased individual. In this nonlimiting example, reef ball 81 may be constructed such that the individual's ashes are actually mixed into the materials used to make reef ball 81. In this nonlimiting example, if reef ball 81 is constructed of a material that promotes coral growth, the person's ashes may be mixed in with raw materials used to form reef ball 81 such that the person's ashes become integrated and a part of reef ball 81.

Alternatively, an additional nonlimiting example comprises reef ball 81 having a compartment for storing a person's ashes, much like in vessel 19, as described above. Regardless of how the deceased individual's ashes are contained in reef ball 81, the reef ball 81 may be deposited on the sea bed floor 61 from boat 58, as shown in FIG. 6, such that it sinks and comes to a point of rest on the seabed floor 61.

In this nonlimiting example, reef ball 81 is shown in a generally round shape. However, one of ordinary skill in the art would know that reef ball 81 may be constructed of any shape or size. Additionally, reef ball 81 may be constructed of material so as to promote coral growth and not otherwise harm the underwater habitat for the fish and other living creatures in water 14.

Thus, returning to FIG. 2, one or more of the areas of the underwater burial garden 10 may be reserved for the deposited reef balls. As a nonlimiting example, one or more underwater areas around island 20 having poor topologies for the underwater burial garden 10, as described in FIGS. 1–6. Therefore, these areas may be utilized for deposit of reef ball 81. In this nonlimiting example, area 32 of FIG. 2 may be reserved for the deposit of reef balls 81 due to its topology or other conditions that one of ordinary skill in the art would know would make that a desirable location.

Figure 8:
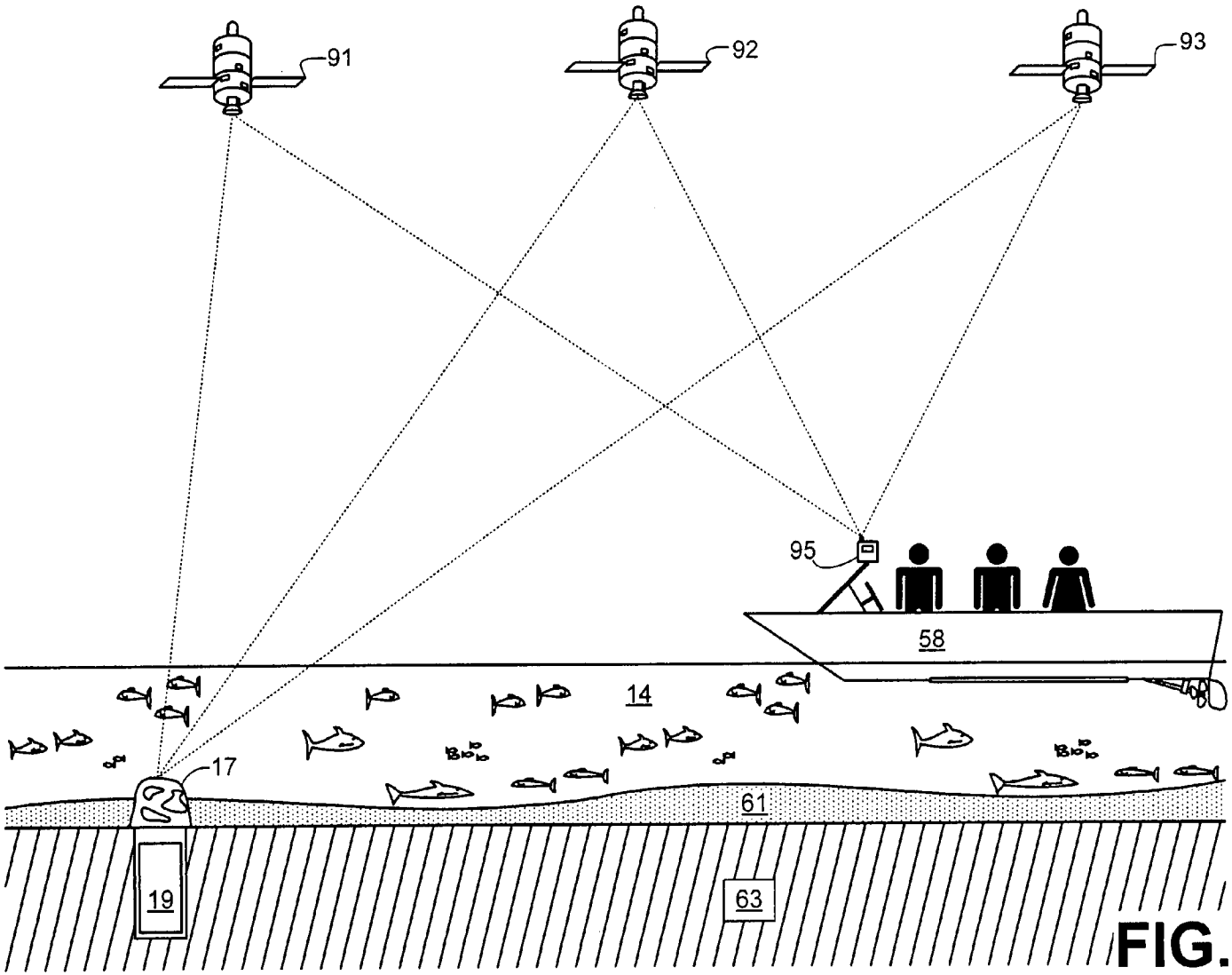
FIG. 8 is a diagram depicting a method of locating and viewing an underwater burial site, such as depicted in FIG. 1.

FIG. 8 is an alternative embodiment to the diagram depicted in FIG. 6. In this nonlimiting example, the passenger boat 58 may locate the position of cap 17 via a global positioning system ("GPS"), which employs one or more satellites 91, 92, 93 with receiver 95. One of ordinary skill in the art would know that the GPS coordinates for cap 17 may be previously established such that receiver 95 may assist the passengers in boat 58 to relocate that exact position so as to position boat 58 directly over cap 17, which may correspond to the deceased loved one of the passengers of boat 58. Alternatively, swimmers or scuba divers may also locate cap 17 with an underwater version of transceiver 95. Nevertheless, one of ordinary skill in the art would also know that other location methods could be utilized for locating the cap for their deceased loved one. As nonlimiting examples, buoys, signs, and other devices may be employed in addition to the method depicted in FIG. 8.

Consequently, the underwater burial garden 10 as shown in FIG. 2, as well as the other figures of this disclosure, establish a method and system for individuals to locate their final resting place underwater, but in a method wherein individuals left behind may return and pay respects in the future. By using materials that are friendly in the underwater environment, as shown herein, the underwater burial garden 10 may last for hundreds and perhaps even thousands of years in the future.

Figure 9:
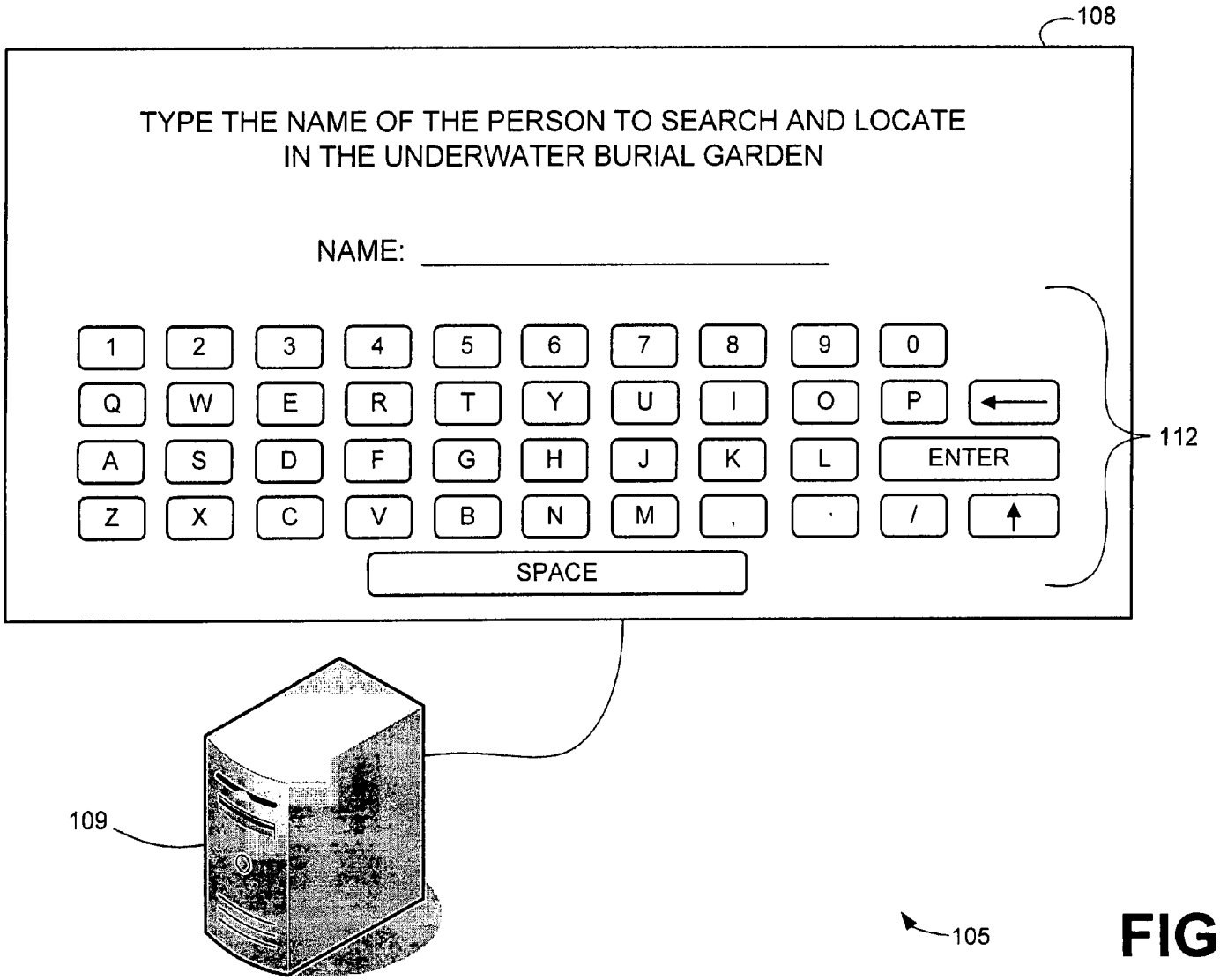
FIG. 9 is a diagram of a nonlimiting exemplary interactive system that may be implemented to display information about deceased individuals whose final resting place is the underwater burial garden of FIG. 2.

As stated above in regard to FIG. 2, island 20 may include a memorial center 22, which may be a structure developed with interactive areas regarding individuals who have been cremated and buried in a plot in the underwater burial garden 10. FIG. 9 is a diagram of a nonlimiting exemplary interactive system 105, which may appear as display 108 that may be coupled to a computing and/or media delivery system 109, which is hereinafter referred to as computer 109. One of ordinary skill in the art would know that computer 109 may be a typical personal computing device with a processor, memory, and one or more peripheral devices.

As a nonlimiting example, computer 109 may interact with display 108 that may include a touch screen keypad 112. (or may be coupled to another type of data entry device). Thus, a family member or friend of a deceased individual may enter the decedent's name with the touch screen keypad 112. Upon entering the name, computer 109 may respond by presenting electronic media information, such as a short video or movie about and/or including the decedent, which may be stored in a memory coupled to the computer 109. Thus, the experience of visitors to the underwater burial garden 10 may be enhanced in this manner.

In addition to displaying information about the decedent, computer 109 may be configured to provide location information and/or mapping information to enable visitors to locate a single plot in the underwater burial garden 10. As a nonlimiting example, display 108 may be driven by computer 109 to display mapping coordinates or other location information enabling precise location of any specific plot.

Figure 10:
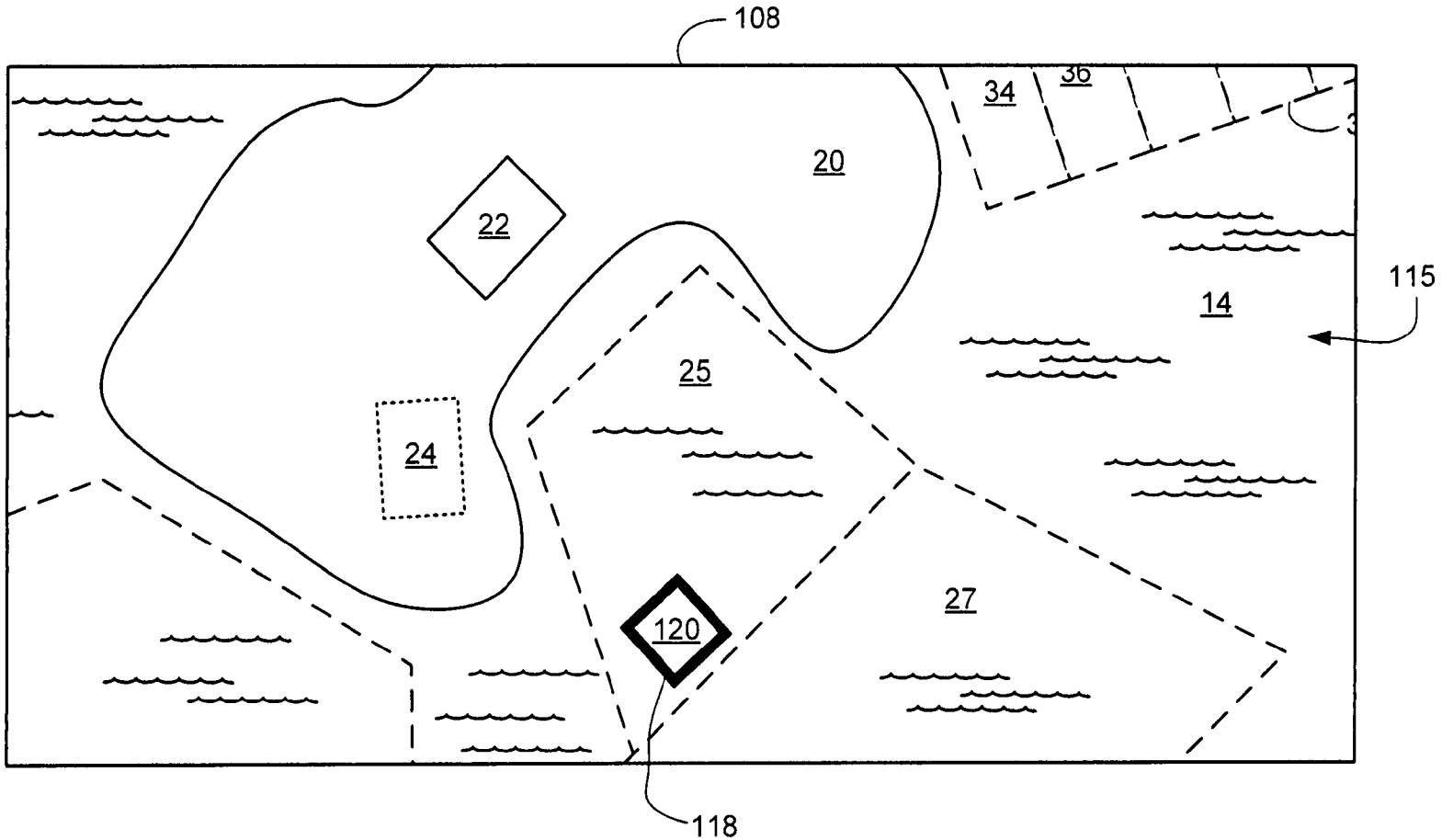
FIG. 10 is a diagram of a mapped portion of the underwater burial garden of FIG. 2, as displayed on the display of FIG. 9.

FIG. 10 is a diagram of a mapped portion of the underwater burial garden 10 of FIG. 2, as displayed on display 108 of FIG. 9. In this nonlimiting example, wherein a visitor enters a decedent's name via keypad 112, computer 109 may display map 115 with highlighted emphasis 118 around quadrant 120, which may be where the cremated remains and associated cap 17 (FIG. 5) with marker plate 51 (FIG. 5) are positioned.

Figure 11:
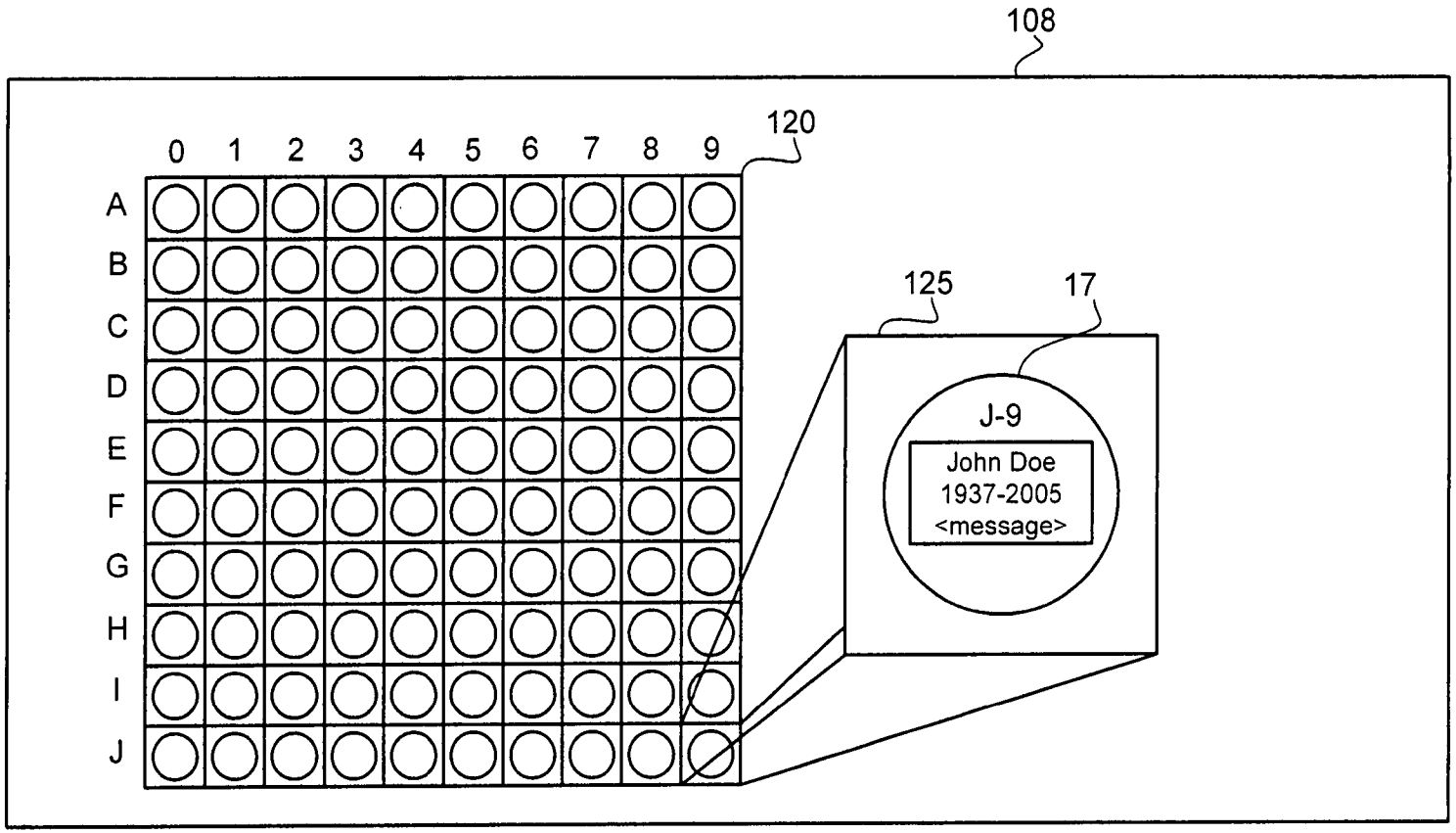
FIG. 11 is a nonlimiting exemplary diagram of a quadrant displayed in FIG. 10 containing the location of a plot of a decedent buried in the underwater burial garden of FIG. 2.

FIG. 11 is a nonlimiting exemplary diagram of quadrant 120 that is highlighted in FIG. 10, which may contain the remains of a decedent to be located. In this nonlimiting example, computer 109 and display 108 may cause quadrant 120 to be displayed in a manner indicating the exact plot 125 housing the remains of the decedent to be located. In this nonlimiting example, among others, an alphanumeric X-Y coordinate system could be implemented, as shown in FIG. 11, so that each plot in quadrant 120 has a separate identifier, which could be located on the cap 17, as shown. Thus, in the nonlimiting example of FIG. 11, cap 17 may include the identifier "J-9."

One of ordinary skill in the art would know, however, that other types of plot locating systems could be implemented without varying from the concept of this disclosure. As an additional nonlimiting example, display 108 could be configured to display global positioning system coordinates of the decedent's plot, which could thereafter be located with the assistance of receiver 95 (FIG. 8). Thus, visitors to the underwater burial garden 10 could always return and pay respects to their deceased loved ones, which could be a pet as well as a person.

One of ordinary skill in the art would know that each hole could be configured to a predetermined depth so as to hold one or more additional vessels 19 in either a stacked or side-by-side orientation. As a nonlimiting example, the families may choose to share a single burial plot, such as plot 49 of FIG. 3, so that each family member is buried together.

Furthermore, one of ordinary skill in the art would understand that this disclosure includes situations wherein a single burial plot, such as plot 49 of FIG. 3, contains multiple drilled holes, such as hole 75 of FIG. 4A. Plus, as discussed above, each hole in a plot may contain one or more vessels each with a different person's cremated remains. As a nonlimiting example, a family could elect to purchase a larger sized burial plot, such as described above, so that each person in the family could have a portion or even all of his or her cremated remains contained in a vessel in one of the holes in the larger sized plot.

It should be emphasized that the above-described embodiments and nonlimiting examples are merely possible examples of implementations, merely set forth for a clear understanding of the principles disclosed herein. Many variations and modifications may be made to the above-described embodiment(s) and nonlimiting examples without departing substantially from the spirit and principles disclosed herein. All such modifications and variations are intended to be included herein within the scope of this disclosure and protected by the following claims.

The invention claimed is:

1. A method for establishing an underwater burial garden, comprising the steps of:

drilling one or more holes into an underwater floor surface to a predetermined depth, each hole at a predetermined location;

positioning a sealed vessel into each hole, each sealed vessel containing ashes of a cremated individual; and placing a cap over each hole, the cap having a plate positioned thereon with text pertaining to the cremated individual.

2. The method of claim 1, wherein the cap is one of a reef cap, a bronze cap, and a coral configured cap.

3. The method of claim 1, wherein the plate is a bronze plate containing the name of the cremated individual, dates of birth and death of the cremated individual, and additional information.

4. The method of claim 1, further comprising the step of:

positioning a core drill over the predetermined location for drilling each hole.

5. The method of claim 1, further comprising the steps of:

mapping the predetermined location of each hole;

referencing each mapped hole to the cremated individual contained in the hole; and presenting mapping information of each hole for locating one specific hole containing a particular cremated individual in the underwater burial garden.

6. The method of claim 5, wherein the mapping information is presented on a display coupled to a searchable system, the display and searchable system positioned in a memorial center on land proximate to the underwater burial garden.

7. The method of claim 6, wherein the memorial center includes a cemetery section of a plurality of markers, each marker containing information about the respective cremated individual.

8. The method of claim 5, wherein the predetermined location is mapped according to a coordinate system, and wherein the underwater burial garden contains a plurality of indicators corresponding to the coordinate system.

9. The method of claim 1, further comprising the steps of:

establishing global positioning coordinates for each hole; and locating each hole via the established global positioning coordinates.

10. The method of claim 1, further comprising the steps of:

designating a group of predetermined locations each containing at least one of the holes and the group positioned in a predetermined area for cremated individuals corresponding to a predetermined classification.

11. The method of claim 10, wherein the predetermined classification corresponds to service in a branch of the military.

12. The method of claim 10, wherein the predetermined classification corresponds to a career.

13. The method of claim 10, wherein the predetermined classification corresponds to a specific interest common to each cremated individual in the group.

14. The method of claim 1, further comprising the steps of:

establishing each predetermined location as an underwater burial plot having predetermined dimensions;

positioning the underwater burial plots having a first predetermined dimension in a first grouped location; and positioning the underwater burial plots having a second predetermined dimension in a second grouped location.

15. The method of claim 14, wherein the first predetermined dimension of each underwater burial plot in the first grouped location is larger than the second predetermined dimension of each underwater burial plot in the second grouped location, and wherein a sale price for each underwater burial plot in the first grouped location is greater than a sale price for each underwater burial plot in the second grouped location.

16. The method of claim 1, further comprising the steps of:

associating a sale price for each hole in the predetermined location in association with a predetermined criteria, wherein at least one of the predetermined criteria is water depth, location from land, or topology of the floor surface.

17. The method of claim 1, further comprising the step of:

positioning a boat over the predetermined location of a particular one of the holes containing the ashes of a particular cremated individual.

18. The method of claim 17, wherein the boat includes a floor partition enabling viewing of the cap on the floor surface through the floor partition.

19. The method of claim 17, wherein the boat is positioned over the predetermined location according to a global positioning system transceiver and global positioning system coordinated associated with the particular hole containing the ashes of a particular cremated individual.

20. The method of claim 1, wherein the cremated individual is an animal.

21. The method of claim 1, wherein the cap is constructed of a material that promotes coral growth.

22. The method of claim 1, further comprising the step of:

positioning one or more additional sealed vessels within each hole, each one or more additional sealed vessels containing ashes of a cremated individual.

23. The method of claim 1, further comprising the step of:

drilling two or more of the holes within a single plot of the underwater burial garden.

* * * * *